US007272917B2

(12) United States Patent
Spatafora et al.

(10) Patent No.: US 7,272,917 B2
(45) Date of Patent: Sep. 25, 2007

(54) METHOD FOR OVERWRAPPING PRODUCTS AND PACKETS IN PARTICULAR

(75) Inventors: Mario Spatafora, Granarolo (IT); Fabrizio Tale', Bologna (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 11/282,820

(22) Filed: Nov. 21, 2005

(65) Prior Publication Data

US 2006/0107620 A1 May 25, 2006

(30) Foreign Application Priority Data

Nov. 19, 2004 (IT) ..... BO2004A0720

(51) Int. Cl.
*B65B 7/20* (2006.01)
*B65B 11/32* (2006.01)
*B65B 51/14* (2006.01)

(52) U.S. Cl. ..... 53/491

(58) Field of Classification Search ..... 53/234, 53/376.4, 376.7, 491
See application file for complete search history.

(56) References Cited

U.S. PATENT DOCUMENTS

| | | | | |
|---|---|---|---|---|
| 3,537,232 | A * | 11/1970 | Mateyka et al. | 53/234 |
| 4,092,816 | A * | 6/1978 | Seragnoli | 53/234 |
| 4,202,151 | A * | 5/1980 | Focke et al. | 53/372.2 |
| 4,621,480 | A * | 11/1986 | Aiuola et al. | 53/234 |
| 4,823,536 | A * | 4/1989 | Manservigi et al. | 53/466 |
| 5,809,747 | A * | 9/1998 | Spatafora | 53/464 |
| 5,839,253 | A * | 11/1998 | Draghetti | 53/234 |
| 6,000,199 | A * | 12/1999 | Boldrini | 53/466 |
| 6,223,506 | B1 * | 5/2001 | Ghini et al. | 53/463 |
| 6,516,589 | B1 * | 2/2003 | Draghetti et al. | 53/466 |
| 6,722,109 | B1 | 4/2004 | Focke | |

FOREIGN PATENT DOCUMENTS

| | | |
|---|---|---|
| DE | 3824315 | 1/1990 |
| EP | 0756993 | 2/1997 |
| EP | 0795473 | 9/1997 |
| EP | 1055603 | 11/2000 |
| EP | 1103465 | 5/2001 |
| EP | 1260442 | 11/2002 |
| EP | 1361158 | 11/2003 |
| GB | 495261 | 11/1938 |
| GB | 2220910 | 1/1990 |

* cited by examiner

*Primary Examiner*—John Sipos
(74) *Attorney, Agent, or Firm*—Timothy J. Klima

(57) ABSTRACT

Packets of prismatic geometry referable to a longitudinal axis, presenting two larger side faces, two smaller flank faces and two end faces, are overwrapped by a method including a step in which each packet, enveloped initially by a tubular wrap projecting beyond the two end faces, is inserted into a holder of a transfer wheel in such a way that two appendages of the tubular wrap projecting at either end from a first flank face of the packet are flattened over the end faces; the appendages are pinned immediately along two lines coinciding substantially with the corner edges of the end face as the packet enters the relative holder, and held stably in position during a subsequent step of transferring the single packets from a feed station to an outfeed conveyor.

8 Claims, 5 Drawing Sheets

METHOD FOR OVERWRAPPING PRODUCTS AND PACKETS IN PARTICULAR

BACKGROUND OF THE INVENTION

The present invention relates to a method and to a relative unit for overwrapping products generally and packets in particular.

The invention finds application to advantage in the tobacco industry, for end-of-line operations in which leaves or sheets cut from a strip of transparent material are used to overwrap packets containing tobacco products, and in particular packets of cigarettes, to which reference is made explicitly in the present specification albeit implying no limitation in scope.

More particularly, the present invention relates to a method for overwrapping packets substantially of rectangular prismatic shape delimited axially by two end faces, and laterally by two larger faces and two smaller or flank faces extending parallel to the longitudinal axis of the rectangular prism.

A typical overwrapping unit comprises conveyor means by which the packets are taken up together with relative sheets of material, whereupon each sheet is formed into a tubular wrap about the respective packet, coaxial with the longitudinal axis of the selfsame packet and clinging thus to the two larger faces and the two flank faces.

The two meeting edges of the sheet overlap along one flank of the packet and are sealed together so as to anchor the tubular wrap, which projects at each end beyond the end faces.

Conventionally, the overwrapping is completed by making a succession of end folds against each end face, first folding and flattening an appendage of the sheet projecting from one flank face, then the appendage projecting from the other flank face, and finally the appendages projecting from the larger faces, which are flattened one over the other.

Adopting a different overwrapping method, as disclosed for example in Europe patent n° 1260442, the first appendage projecting from a first flank face of the packet can be folded against the end face before the tubular wrap is sealed.

Given the characteristics of the overwrapping materials widely employed, typically polypropylene or other heat-sealable plastics, which are highly elastic and unable to retain a fold unassisted, the conveyor means must be equipped with mechanisms capable of holding the appendages of the wrap in place after the end folds have been made.

The function of such mechanisms will cease the moment that the end folds are fastened one to another by a final heat-sealing step that completes the overwrapping operation.

The method in question nonetheless imposes definite limitations on overwrapping machines used in the industry, and while suitable for those of reciprocating design, it is not applicable to more modern machines typified by continuous motion and high output speeds.

The object of the present invention is to provide a method of overwrapping packets such as will meet the practical requirements indicated above while operating at the high output speeds of which modern cigarette makers and packers are capable.

SUMMARY OF THE INVENTION

The stated object is realized according to the present invention in a method for overwrapping packets of substantially rectangular prismatic shape presenting two larger side faces parallel one with another and with a longitudinal axis, two smaller or flank faces disposed parallel to the longitudinal axis and at right angles to the larger faces, and two end faces lying transverse to the longitudinal axis.

The method disclosed envisages the steps of inserting single packets into holders carried by a transfer wheel, each disposed with the longitudinal axis parallel to the axis of the wheel and enveloped by a tubular wrap projecting beyond the two end faces, directing each packet into the relative holder in such a way that appendages of the tubular wrap projecting from one flank face of the packet are folded against the respective end faces, and finally stabilizing the appendages during the step of inserting the packet into the relative holder and/or during a step of transferring the single packets from a feed station to an outfeed conveyor.

The stated object is realized similarly in a unit for overwrapping packets typically of rectangular prismatic shape, presenting two larger side faces parallel one with another and with a longitudinal axis, two smaller or flank faces disposed parallel to the longitudinal axis and at right angles to the larger faces, and two end faces lying transverse to the longitudinal axis.

Such a unit comprises a feed conveyor by which packets enveloped each in a tubular wrap projecting beyond the two end faces are advanced singly toward a feed station, and a transfer wheel equipped with a plurality of gripper assemblies, each affording a holder able to admit a packet disposed with its longitudinal axis parallel to the axis of the wheel, by which the packets are transferred from the feed station to a release station serving the outfeed conveyor.

Each holder is composed of pinching means able to restrain the packet, and two side walls by which appendages of the tubular wrap projecting from one flank face of the packet are folded against the respective end faces, the pinching means and the fold-making side walls together constituting means by which to stabilize the folded appendages.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
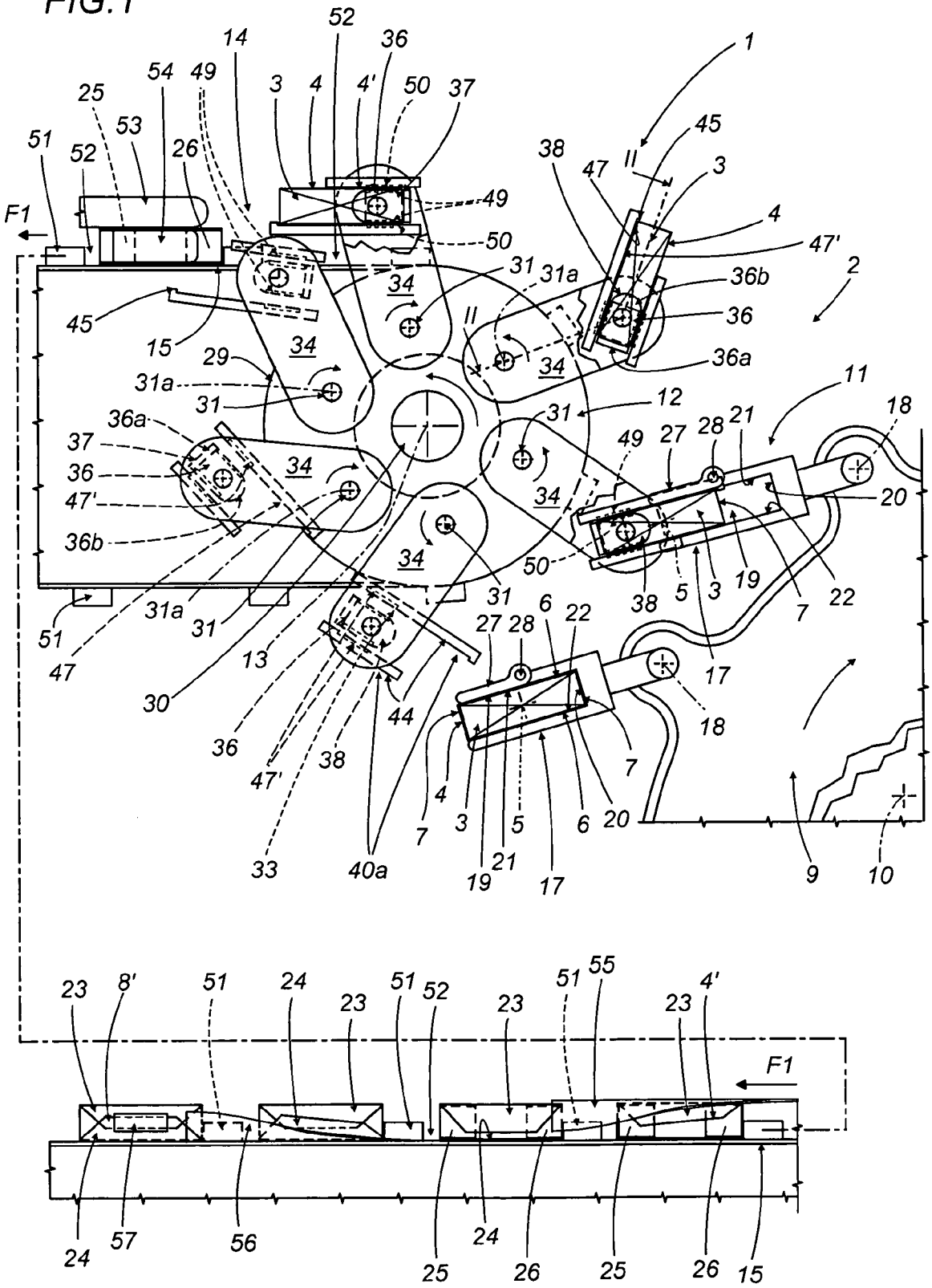
FIG. 1 shows a portion of an overwrapping unit according to the present invention, viewed schematically in elevation with certain parts cut away, and illustrated in a preferred embodiment.

Referring to FIG. 1 of the drawings, 1 denotes an outfeed portion, in its entirety, of a unit 2 for overwrapping packets of cigarettes 3 in leaves or sheets 4 of transparent material, for example polypropylene.

Such packets 3 are rectangular and prismatic in shape, referable to a longitudinal axis denoted 5, presenting two larger side faces 6 parallel one with another and with the longitudinal axis 5, two smaller or flank faces 7 disposed parallel to the longitudinal axis 5 and at right angles to the larger faces 6, and two end faces 8 disposed transversely to the longitudinal axis 5.

The outfeed portion 1 of the unit 2 includes a feed conveyor 9 (part of which visible in FIG. 1) set in rotation clockwise, as viewed in FIG. 1, about an axis denoted 10, by which successive packets 3 are advanced with their axes 5 disposed parallel to the axis 10 of the conveyor, each enveloped in part by a sheet 4 of transparent material, toward a feed station 11.

Also forming part of the outfeed portion 1 is a transfer wheel 12 set in rotation anticlockwise, as viewed in FIG. 1, about an axis 13 parallel to the axis 10 of the conveyor 9, interposed between the feed station 11 and a release station 14 serving a substantially horizontal outfeed conveyor belt 15 of which one end is looped about a return pulley coinciding with the transfer wheel 12.

The sheets 4 are wrapped around the respective packets 3 by the conveyor 9 in conventional manner, not illustrated, so that each is formed into a tubular wrap 4' (see FIG. 5) centered on an axis coinciding with the longitudinal axis 5, that is, a wrap 4' clinging to the four side faces 6-6 and 7-7 of the packet 3 and secured along one flank face 7 by a sealed seam 16 uniting two overlapped edges of the sheet 4.

The feed conveyor 9 is equipped peripherally with a plurality of assemblies 17, equispaced one from another and pivotable about axes 18 disposed parallel to the axis 10 of rotation, each affording a holder 19 proportioned to accommodate a single packet 3 wrapped in a relative sheet 4.

The holder 19 is delimited by a back wall 20 designed to make contact with one flank 7 of the packet 3, and two side walls 21 and 22 designed to engage the two larger side faces 6 of the packet. The front part of the holder 19, opposite the back wall 20, remains open.

Figure 3:
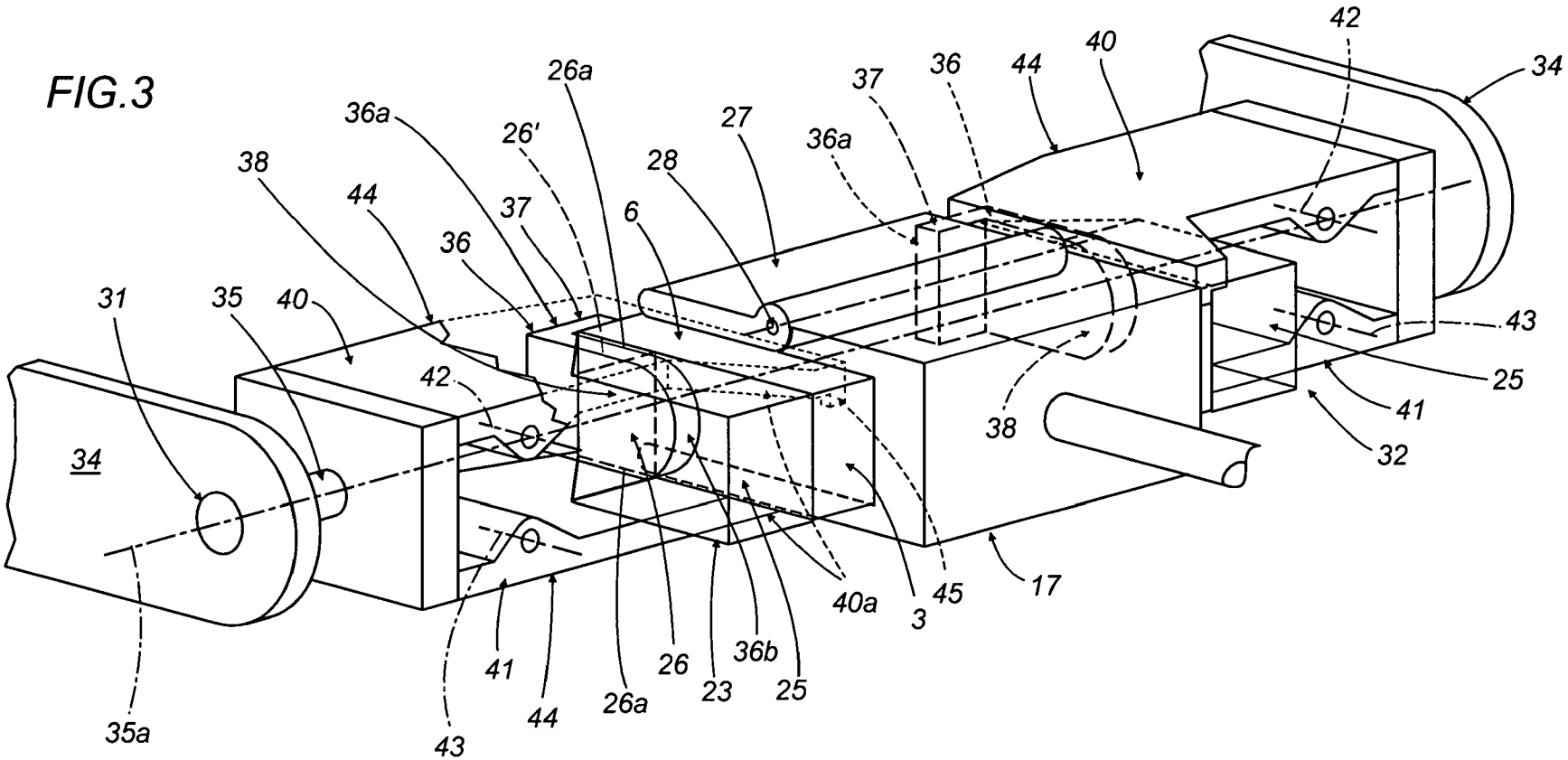
FIG. 3 shows a detail of FIG. 1, viewed schematically and in perspective.

As discernible from FIG. 3, and for reasons that will become clear in due course, the holder 19 is proportioned in such a way that the two ends of the packet 3 project one on either hand, together with the two ends of the tubular wrap 4'.

Figure 5:
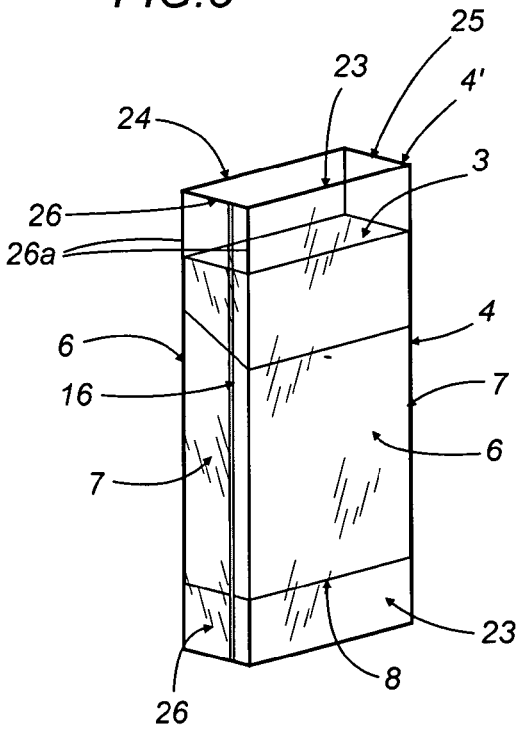
FIGS. 5 to 9 are perspective views illustrating a sequence of five overwrapping steps performed on a packet of cigarettes by the unit of FIG. 1.

With reference to FIG. 5, each end of the tubular wrap 4' comprises two appendages denoted 23 and 24 projecting from the two larger side faces 6, an appendage 25 projecting from the flank face 7 offered to the back wall 20, and an appendage 26 projecting from the flank face 7 along which the sealed seam 16 is applied.

One portion 27 of the side wall denoted 21 (which advances forwardmost in the direction of rotation of the conveyor 9) is mounted pivotably to a hinge pin 28 parallel with the axis 10 of the conveyor, coupled to actuator means (not illustrated), and capable thus of combining with the opposite side wall 22 to function as gripping means by which the packet 3 is retained internally of the holder 19.

Figure 2:
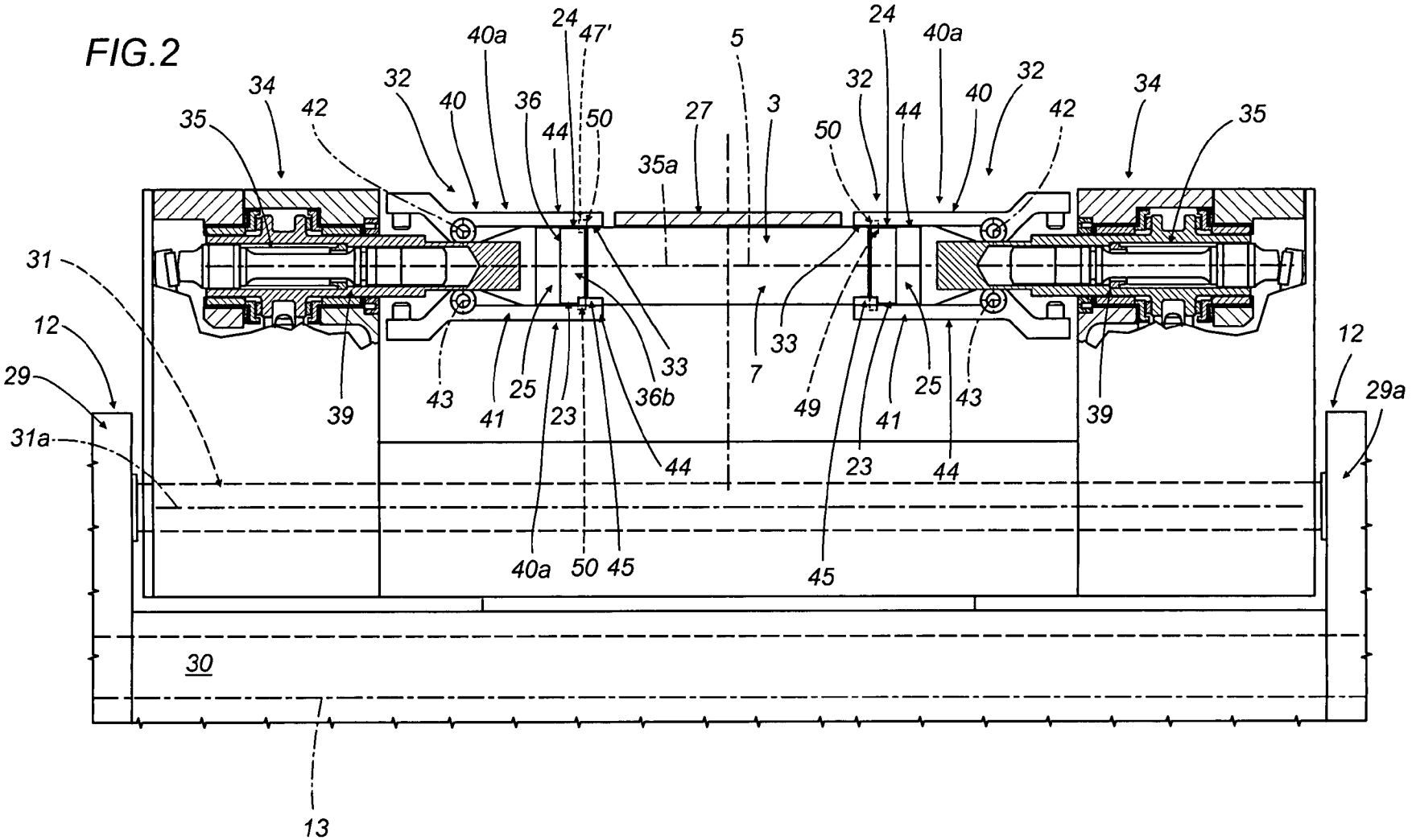
FIG. 2 shows a detail of the unit in FIG. 1, viewed schematically in a section on II-II.

As illustrated in FIGS. 1 and 2, the transfer wheel 12 comprises a drum 29 mounted to a shaft 30 of which the axis coincides with the axis 13 of the wheel.

The drum 29 is equipped at the right hand end, as viewed in FIG. 2, with a cylindrical flange **29*a* centered on the axis 13 and carrying a number of shafts 31 centered on respective axes 31' and extending toward the opposite end of the drum 29**.

The shafts 31 are equispaced angularly around and parallel to the axis 13 of the wheel, and serve to carry respective gripper assemblies 32 each affording a holder 33 such as will accommodate a packet 3 disposed with its axis 5 parallel to the aforementioned axis 13.

Each assembly 32 comprises two mutually parallel arms 34 anchored at respective ends to the opposite ends of a single shaft 31.

The free end presented by each arm 34 of the gripper assembly 32 serves to carry a respective shaft 35 of which the axis **35*a* is disposed parallel to the axis 13 of the wheel 12. The two shafts 35 are axially aligned one with another and carry the holder 33** between their respective ends.

Both sets of shafts 31 and 35 are coupled to actuator means (not illustrated) such as will cause the arms 34 to pivot on the respective axes **31*a* relative to the drum 29, and the holders 33 to rotate about the respective axes 35*a* relative to the arms 34, during the rotation of the transfer wheel 12 about its axis 13**.

In the example illustrated, the single holder 33 comprises two L-shaped elements denoted 36, each mounted to the end of a respective shaft 35.

The elements 36 in question present two first portions **36*a* lying in a common plane, parallel to the axis 13 of the wheel and combining to establish a back wall 37 of the holder 33 such as will engage the flank face 7 of the packet 3 occupying the open front of the holder 19 afforded by each assembly 19 of the conveyor 9**.

The elements 36 also present two portions **36*b* normal to the first portions 36*a*, disposed mutually parallel and separated by a distance substantially equal to the longitudinal dimension of a single packet 3**, of which the free ends are fashioned with a rounded profile.

The two parallel portions **36*b* establish two further walls of the holder 33, and more exactly two side walls 38 by which the two corresponding appendages 26 of the tubular wrap 4' are folded at the moment when the packet 3 is directed into the holder 33**.

Figure 6:
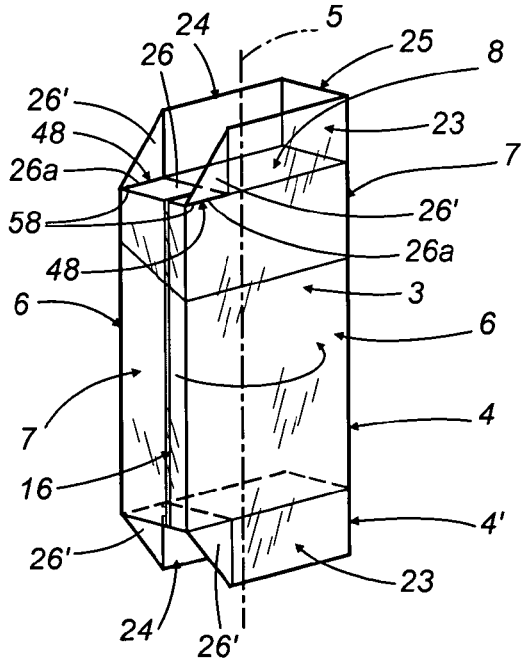

As illustrated in FIG. 6, the step of folding each appendage 26 has the effect of forming two triangular folds 26', doubled against the innermost surfaces of the adjoining appendages 23 and 24.

Each shaft 35 of the gripper assembly 32 is ensheathed by a tubular element or sleeve 39 that carries gripping means **40*a* comprising two jaws 40 and 41 of width substantially matching the width of the packet 3, pivotable about respective axes 42 and 43 extending mutually parallel and transverse to the shaft axis 35*a*. The gripping means 40*a* in question constitute means 44 by which to pinch the packet 3 across the opposite endmost edges of the larger side faces 6, and are capable of movement induced by actuator means (not illustrated) between an open position, illustrated in FIG. 1, and a closed position illustrated in FIGS. 1, 2 and 3**.

The jaws denoted 40, uppermost as illustrated in FIG. 3, present a free gripping end of width substantially identical to that of the packet 3 and are equipped on the side farthest from the back wall 37 with a drag tooth 45 designed to engage one of the flank faces 7 of the packet 3 when released from the conveyor 9 to the transfer wheel 12.

Figure 4:
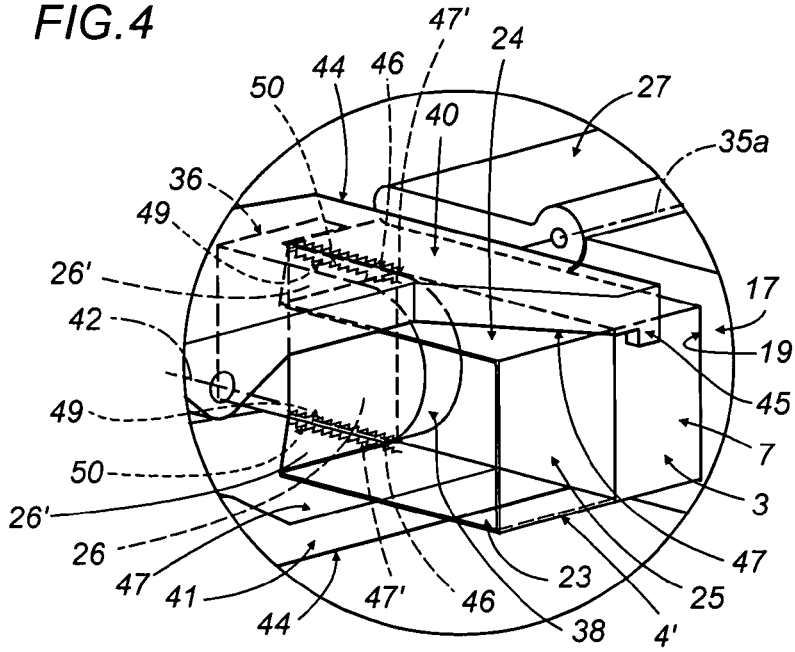
FIG. 4 is an enlarged detail of FIG. 3.

As illustrated in FIG. 4, it will be seen that with the pinching means 44 in the closed position, the two fold-making longitudinal corner edges 46 of each side wall 38 engage substantially in contact with a gripping face 47 of the corresponding jaw 40 and 41.

Figure 7:
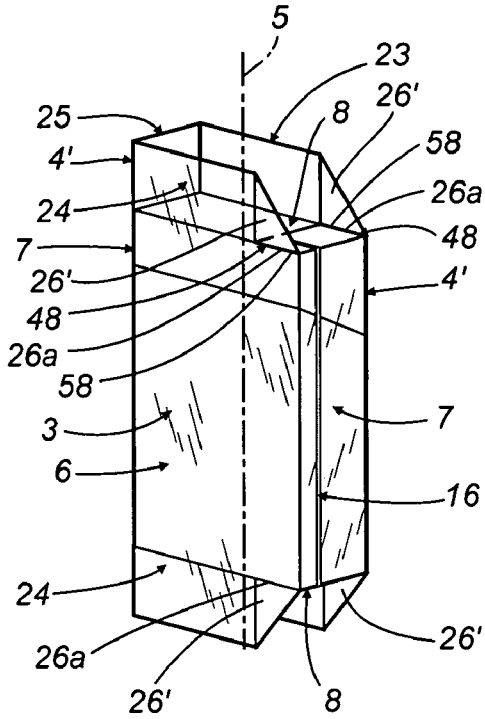
Figure 8:
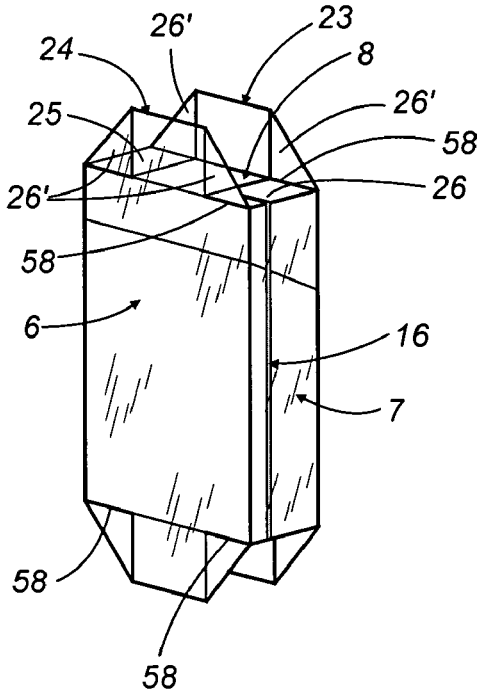

Consequently, as illustrated in FIGS. 6, 7 and 8, each edge **26*a* of a relative folded appendage 26, coinciding with one side of the relative triangular fold 26' and overlapping part of the corresponding corner edge of a respective end face 8, will be pinned between the corner edge 46 of the wall 38 and the face 47 of the jaw together with a part 48 of the edge of the appendage 23 or 24 projecting from the respective larger side face 6 of the packet 3**.

As illustrated in FIGS. 1 and 4, the unit 2 further comprises heating means denoted 49, located along the two opposite longitudinal corner edges 46 of each fold-making side wall 38 and consisting, for example, in electrical resistance elements.

Similarly, the unit 2 comprises heating means 50 located on an area 47' of the gripping face 47 presented by each jaw 40 and 41, positioned to coincide with the aforementioned corner edges 46.

The outfeed conveyor belt 15, which advances in the direction denoted F1, is equipped with slats 51 delimiting pockets 52 each designed to accommodate a relative packet 3.

53 denotes a horizontal guide element positioned above the top branch of the belt 15 at a distance substantially equal to the depth of one packet 3.

54 denotes one of two second fold-making side walls (one only being visible in FIG. 1) by which the two appendages 25 of the tubular wrap 4' opposite to the appendages denoted 26 are flattened against the end faces 8 (see FIG. 8).

Figure 9:
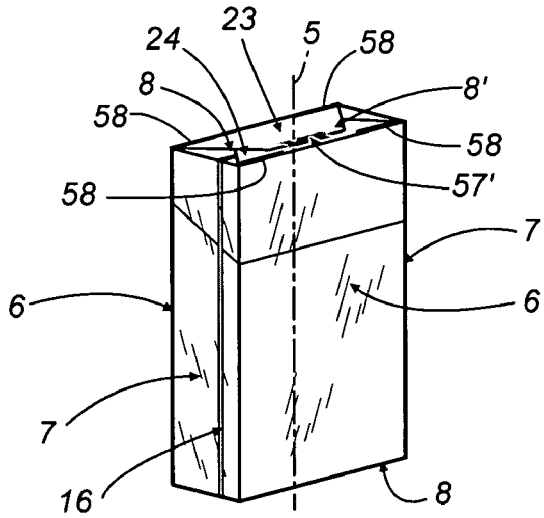

55 and 56 denote two helical fold-making elements by which the remaining appendages 23 and 24 of the tubular wrap 4' extending on either side from the two larger faces 6 of the packet 3 are flattened against the end faces 8, overlapping one another (see FIGS. 8 and 9).

57 denotes one of two heat-seal devices, one only being visible in FIG. 1, by which the two appendages 23 and 24 are bonded one to another over a substantially central area of the end face 8, excluding the aforementioned edges 26*a* and 48, to complete the ends 8' of the overwrapping.

In operation, each holder 19 of the conveyor 9 containing a single packet 3 approaches the entry to the feed station 11, which extends through an arc of predetermined length, and draws alongside a holder 33 of the transfer wheel 12, the two holders being substantially aligned at this juncture on an axis transverse to the longitudinal axis 5 of the packet 3.

During this step, the packet 3 will be actively restrained by the aforementioned gripping means 22 and 27 of the one holder 19, whilst the gripping means 40*a* of the other holder 33 are spread, thus allowing interpenetration of the two holders to the point at which the flank face 7 of the packet 3 presenting the sealed seam 16 registers against the back wall 37, and the ends projecting from the first gripping means 22 and 27 are caused to locate between the jaws 40 and 41 of the second gripping means 40*a*.

At this point, the jaws 40 and 41 are caused by respective actuator means to close and the gripping means 22 and 27 are spread, allowing the teeth 45 to draw the packet 3 from the holder 19 at the exit end of the feed station 11.

Restrained between the jaws 40 and 41, with the transfer wheel 12, the arms 34 and the holders 33 rotating anticlockwise (as viewed in FIG. 1), the packet 3 arrives at the release station 14 turned through an angle of some 180° from the position in which it had left the holder 19 of the conveyor 9.

On entering the release station 14, accordingly, the packet 3 will assume a position in which the larger side face 6 engaging the bottom jaw 40 lies substantially in the same plane as that occupied by the top branch of the conveyor belt 15.

At this stage, the gripping means 40*a* are spread, and the flank face 7 opposite to that presenting the sealed seam 16 on the tubular wrap 4' is engaged by a slat 51 passing between the two pairs of jaws 40 and 41, through the gap that separates the aforementioned portions 36*a* of the two L-shaped elements denoted 36.

As the packet 3 advances along the belt 15, the two projecting appendages 25 are flattened by the second fold-making side walls 54 against the respective end faces 8, whereupon the remaining appendages 23 and 24 are flattened by the helical fold-making elements 55 and 56 likewise against the end faces 8, one overlapping the other.

Finally, the two appendages 23 and 24 are secured one to another by the heat-seal devices 57 to complete the closure of the overwrapping 4.

It will be seen that the step of transferring the packet 3 from the feed conveyor 9 to the transfer wheel 12, during which the respective holders 19 and 33 are caused to interlock, comprises the step of stabilizing the appendages denoted 26.

This stabilizing action, applied along respective lines denoted 58 in the drawings, is generated by the combined action of the aforementioned edges 26*a* and 48 of stabilizing means afforded by the longitudinal corner edges 46 of each side wall 38 and the contact areas 47' of the gripping faces 47.

The stabilizing means 46 and 47' in question might operate applying compression alone, or with the aid of the aforementioned heating means 49 and 50. Either solution will ensure that the folded appendage 26 remains stably in place during the remainder of the transfer steps described above.

To advantage, moreover, and as discernible from FIG. 9, the heat-seal 57' applied to each pair of appendages 23 and 24 by the heat-seal devices 57 is located in an area of the relative end 8' not occupied by the stabilization lines 58.

It will be seen from the foregoing that there is no need to equip the unit 2 with mechanisms serving specifically to retain the first appendages 26 in the position assumed following the folding steps.

In effect, such mechanisms are replaced by the aforementioned stabilizing means 46 and 47', which are one and the same as the means serving to fold the appendages 26 and remain active during the relative folding step and/or during the step of transferring the packets 3 from the feed station 11 to the release station 14.

What is claimed is:

1. A method of overwrapping packets of substantially rectangular prismatic shape presenting two larger side faces parallel one with another and with a longitudinal axis, two smaller or flank faces disposed parallel to the longitudinal axis and at right angles to the larger faces, and two end faces lying transverse to the longitudinal axis, the method comprising:

inserting single packets into holders carried by a transfer wheel, each disposed with the longitudinal axis parallel to an axis of the wheel and enveloped by a tubular wrap projecting beyond the two end faces;

folding appendages of the tubular wrap projecting from one flank face of each packet against the respective end faces of the packet and leaving appendages of the tubular wrap projecting from at least one larger side otherwise unfolded while inserting the packet into the holder and holding the folded appendages against the respective end faces;

heating the folded appendages while they are being held against the respective end faces in and the otherwise unfolded appendages the respective holder to maintain the folded appendages in the folded state upon removal of the packet from the respective holders to an outfeed conveyor.

2. A method as in claim 1, and further comprising restraining each appendage along two lines coinciding substantially with the corner edges of the end face while heating the folded appendages.

3. A method as in claim 1, comprising the steps, effected during the passage of the packet along the outfeed conveyor, of folding the appendages of the tubular wrap projecting from the other flank face of the packet against the respective end faces, folding the appendages projecting from the two larger side faces of the packet against the two end faces to form the ends of the overwrapping, and sealing the self same ends of the overwrapping.

4. A method as in claim 1, comprising the step, effected during the step of transferring packets from the feed station to the outfeed conveyor, of rotating the single holders about respective axes parallel to the axis of the transfer wheel.

5. A method as in claim 1, wherein the step of folding the first appendages of the tubular wrap projecting from one flank face of the packet against the two end faces is effected by fold-making walls constituting two side walls of the holder.

6. A method as in claim 5, wherein the folding step is effected through the agency of the side walls in conjunction with pinching means designed to restrain the packet.

7. A method as in claim 1, comprising the step, effected during the step of transferring packets from the feed station to the outfeed conveyor, of rotating the single holders about respective axes parallel to the axis of the transfer wheel.

8. A method as in claim 1, wherein the step of folding the first appendages of the tubular wrap projecting from one flank face of the packet against the two end faces is effected by fold-making walls constituting two side walls of the holder.

* * * * *